US009247628B2

(12) United States Patent
Khalsa et al.

(10) Patent No.: US 9,247,628 B2
(45) **Date of Patent: *Jan. 26, 2016**

(54) REJECTING NOISE TRANSIENTS WHILE TURNING OFF A FLUORESCENT LAMP USING A STARTER UNIT

(71) Applicant: Zilog, Inc., Milpitas, CA (US)

(72) Inventors: Kamlapati Khalsa, San Jose, CA (US); Roger Ball, Seattle, WA (US)

(73) Assignee: Zilog, Inc., Milpitas, CA (US)

( * ) Notice: Subject to any disclaimer, the term of this patent is extended or adjusted under 35 U.S.C. 154(b) by 225 days.

This patent is subject to a terminal disclaimer.

(21) Appl. No.: 13/961,544

(22) Filed: Aug. 7, 2013

(65) Prior Publication Data

US 2013/0320876 A1 Dec. 5, 2013

Related U.S. Application Data

(63) Continuation of application No. 12/802,090, filed on May 28, 2010, now Pat. No. 8,541,960.

(51) Int. Cl.
*H05B 41/04* (2006.01)
*H05B 41/295* (2006.01)
*H05B 41/298* (2006.01)

(52) U.S. Cl.
CPC ..... *H05B 41/04* (2013.01); *H05B 41/295* (2013.01); *H05B 41/2986* (2013.01)

(58) Field of Classification Search
CPC ..... H05B 37/02; H05B 33/08; H05B 41/04; H05B 41/046; H05B 41/295; H05B 41/2986
USPC ..... 315/46, 116, 246, 313, 362, DIG. 5, 33, 315/94, 224, 250, 291, 294
See application file for complete search history.

(56) References Cited

U.S. PATENT DOCUMENTS

| | | | | |
|---|---|---|---|---|
| 3,794,822 | A * | 2/1974 | Bergmans | 362/18 |
| 3,794,882 | A | 2/1974 | Kitanosono | 315/100 |
| 4,381,476 | A * | 4/1983 | Adachi et al. | 315/101 |
| 4,513,225 | A | 4/1985 | Lemmers et al. | 315/189 |

(Continued)

OTHER PUBLICATIONS

Sinem Coleri Ergen, "ZigBee/IEEE 802.15.14 Summary", Sep. 10, 2004, pp. 1-35.

(Continued)

*Primary Examiner* — Thai Pham
(74) *Attorney, Agent, or Firm* — Imperium Patent Works; Darien K. Wallace; Daniel D. Tagliaferri

(57) ABSTRACT

A local minimum of a current monitoring signal is identified by a starter unit that turns off a fluorescent lamp without using a wall switch. Closing a main switch in the starter unit stops an illuminating current from flowing through a gas in the lamp. The local minimum of the current monitoring signal is reached when an increasing valid sample is identified following four valid samples. A sample is valid if it does not differ from the preceding valid sample by more than a threshold difference based on known properties of the signal. By skipping invalid samples, the local minimum is accurately determined to have been reached despite transient noise spikes in the signal that would trip any voltage threshold used to locate the local minimum. When the main switch is opened at a predetermined time after the local minimum, the illuminating current does not again flow through the gas.

17 Claims, 12 Drawing Sheets

(56) References Cited

U.S. PATENT DOCUMENTS

| | | | | |
|---|---|---|---|---|
| 5,448,136 | A * | 9/1995 | Fischer | 315/105 |
| 5,701,058 | A | 12/1997 | Roth | 315/158 |
| 5,945,786 | A | 8/1999 | Jurek | 315/276 |
| 5,952,794 | A | 9/1999 | Bergman et al. | 315/307 |
| 6,388,399 | B1 | 5/2002 | Eckel et al. | 315/312 |
| 6,504,305 | B1 | 1/2003 | Ohkubo et al. | 315/58 |
| 6,570,346 | B2 | 5/2003 | Incze | 315/291 |
| 6,859,644 | B2 | 2/2005 | Wang | 455/159.2 |
| 7,239,094 | B2 | 7/2007 | Radzinski et al. | 315/307 |
| 7,307,542 | B1 | 12/2007 | Chandler et al. | 340/825.52 |
| 7,446,671 | B2 | 11/2008 | Giannopoulos et al. | 340/825.72 |
| 7,554,274 | B2 | 6/2009 | Wang et al. | 315/317 |
| 7,608,807 | B2 | 10/2009 | Hick et al. | 250/205 |
| 7,667,991 | B2 | 2/2010 | Leyh | 363/132 |
| 7,675,250 | B2 | 3/2010 | Chitta et al. | 315/309 |
| 2004/0101312 | A1 | 5/2004 | Cabrera | 398/172 |
| 2006/0044152 | A1 | 3/2006 | Wang | 340/825 |
| 2009/0026966 | A1 | 1/2009 | Budde et al. | 315/152 |

OTHER PUBLICATIONS

Mikhail Galeev, "Embedded Systems Programming: Will Bluetooth, ZigBee, and 802.11 all have a place in your home? Here's what ZigBee offers for home wireless networking", Apr. 20, 2004, pp. 1-6.

Dan Strassberg, "Simple networks will free many sensors from wires", Apr. 13, 2006, pp. 2-3.

G. Bhatti, A. Mehta, Z. Sahinoglu, J. Zhang, and R. Viswanathan, "Modified Beacon-Enabled IEEE 802.15.4 MAC for Lower Latency", Apr. 2009, pp. 1-6.

Jeffrey Z. Tao, Shivendra S. Panwar, Daqing Gu, Jinyun Zhang, "Performance Analysis for the IEEE 802.15.4 Contention Access Period", downloaded Sep. 2009, pp. 2-19.

Atmel Corporation, "ATAVRFBKIT/EVLB001 Dimmable Fluorescent Ballast User Guide", Oct. 2007, pp. 1-32.

Bob Nelson and Chris Marshall, "Request for Specification Input (RSI) Technical Requirements Document", Apr. 26, 2000, pp. 2-19.

Patrick Kinney, "ZigBee Technology: Wireless Control that Simply Works", Oct. 2, 2003, pp. 2-21.

Bob Heile, "Wireless Sensors and Control Networks: Enabling New Opportunities with ZigBee", Dec. 2006, pp. 2-52.

Royal Philips Electronics, Samsung Electronics Co., Ltd., Sony Corporation and ZigBee Alliance, "ZigBee and RF4CE Set New Course for Consumer Electronic Remote Controls", Mar. 3, 2009, pp. 1-3.

Bo Gao and Chen He, "An Individual Beacon Order Adaptation Algorithm for IEEE 802.15.4 Networks", May 2008, pp. 12-16.

Francis Rubenstein, "After Dali: A Look at What's Next" Jan. 16, 2005, pp. 3-4.

Dali Specification Guide, downloaded Sep. 2009, pp. 5-71.

Daintree Networks, "Introducing ZigBee RF4CE", Apr. 2009, pp. 1-4.

Module: ZigBee Overview, downloaded Sep. 2009, pp. 1-34.

Yao-Jung Wen, "Wireless Sensor and Actuator Networks for Lighting Energy Efficiency and User Satisfaction", Fall 2008, pp. 1-261.

Liang Cheng, "IEEE 802.15.4 MAC Protocol Study and Improvement", Dec. 2007, pp. 1-86.

* cited by examiner

RF-ENABLED STARTER UNITS TURN OFF FLUORESCENT LAMPS OF MULTI-LAMP LIGHT FIXTURE

TURN-OFF OF MULTIPLE FLUORESCENT LAMPS

LAMP TURNED ON

STARTER RECEIVES TURN OFF COMMAND

MICROCONTROLLER MONITORS
SWITCH CURRENT

OPEN SWITCH

```
int find_imon_broad_bottom (void)
{
     unsigned char new_imon_sample;
     unsigned char imon_curm3, imon_curm2, imon_curm1, imon_cur;
     unsigned char imon_delta;
     unsigned char num_samples_since_last_valid = 1;
     unsigned char attempted_starts = 0;
     unsigned char found_good_start = 0;
     do
     {
          imon_curm3 = read_adc_8bit (IMON);
          imon_curm2 = read_adc_8bit (IMON);
          if (imon_curm2 > imon_curm3)
          {
               imon_delta = imon_curm2 - imon_curm3;
          }
          else
          {
               imon_delta = imon_curm3 - imon_curm2;
          }
          if ( imon_delta <= (MAX_IMON_SAMPLE_DELTA +
IMON_SAMPLE_NOISE_EST) )
          {
               imon_curm1 = read_adc_8bit (IMON);
               if (imon_curm1 > imon_curm2)
               {
                    imon_delta = imon_curm1 - imon_curm2;
               }
               else
               {
                    imon_delta = imon_curm2 - imon_curm1;
               }
               if ( imon_delta <= (MAX_IMON_SAMPLE_DELTA +
IMON_SAMPLE_NOISE_EST) )
               {
                    found_good_start = 1;
               }
          }
          if (++attempted_starts >= MAX_IMON_FALSE_STARTS) return -1;
     } while (! found_good_start);
     do
     {
          imon_cur = read_adc_8bit (IMON);
          if (imon_cur > imon_curm1)
          {
               imon_delta = imon_cur - imon_curm1;
          }
          else
          {
               imon_delta = imon_curm1 - imon_cur;
          }
```

FIG. 17A

KEY TO FIG. 17

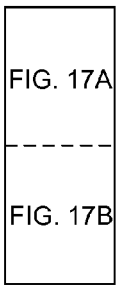

FIG. 17

```
            if ( imon_delta <=
                  ( (num_samples_since_last_valid * MAX_IMON_SAMPLE_DELTA)
                  + IMON_SAMPLE_NOISE_EST) )
            {
                  num_samples_since_last_valid = 1;
            }
            else
            {
                  if (++num_samples_since_last_valid >=
                        MAX_BAD_IMON_SAMPLES) return -1;
            }
      } while (num_samples_since_last_valid > 1);
      while (1)
      {
            new_imon_sample = read_adc_8bit (IMON);
            if (new_imon_sample > imon_cur)
            {
                  imon_delta = new_imon_sample - imon_cur;
            }
            else
            {
                  imon_delta = imon_cur - new_imon_sample;
            }
            if ( imon_delta
                  > ( (num_samples_since_last_valid *
MAX_IMON_SAMPLE_DELTA)
                  + IMON_SAMPLE_NOISE_EST) )
            {
                  if (++num_samples_since_last_valid >=
                        MAX_BAD_IMON_SAMPLES) return -1;
            }
            else
            {
                  num_samples_since_last_valid = 1;
                  if (new_imon_sample > imon_curm3)
                  {
                        return 0;
                  }
                  imon_curm3 = imon_curm2;
                  imon_curm2 = imon_curm1;
                  imon_curm1 = imon_cur;
                  imon_cur = new_imon_sample;
            }
      }
}
```

FIG. 17B

REJECTING NOISE TRANSIENTS WHILE TURNING OFF A FLUORESCENT LAMP USING A STARTER UNIT

CROSS REFERENCE TO RELATED APPLICATIONS

This application is a continuation of, and claims priority under 35 U.S.C. §120 from, nonprovisional U.S. patent application Ser. No. 12/802,090 entitled "Rejecting Noise Transients While Turning Off a Fluorescent Lamp Using a Starter Unit," filed on May 27, 2010, the subject matter of which is incorporated herein by reference.

TECHNICAL FIELD

The described embodiments relate to starter units for fluorescent lamps.

BACKGROUND INFORMATION

Fluorescent light fixtures include tubular fluorescent bulbs. A fluorescent bulb is also referred to here as a fluorescent lamp. The tube is a glass tube that contains an ionizable gas and a small amount of mercury. There are filaments at each end of the tube. Upon application of proper electrical voltages, the filaments can be made to heat up and to ionize the ionizable gas in the tube. If a voltage of adequate magnitude is then provided between the filaments, an electrical arc can be started through the gas in the tube between the filaments. The arc involves a flow of current from one filament, through the ionized gas, and to the other filament. Energetic electrons in this current flow collide with the mercury atoms, thereby exciting the mercury atoms and causing them to emit ultraviolet radiation. The emitted ultraviolet radiation is absorbed by and excites a phosphor coating on the inside of the walls of the tube. The phosphor coating fluoresces and emits radiation in the visible spectrum (i.e., visible light). The visible light passes outward through the glass and is usable for illuminating purposes.

Some such fluorescent light fixtures involve a circuit referred to as a "starter". In a first step, a switch in the starter closes and forms an electrical connection between the filament at one end of a tube and the filament at the other end of the tube such that an alternating current can flow from an AC power source, through a ballast, through one filament, through the closed switch of the starter, and through the second filament, and back to the AC power source. This alternating current flow causes the filaments to heat. The heating of the filaments causes gas surrounding the filaments to ionize. Once the gas is ionized in this way, then the switch in the starter is opened. The opening of the switch cuts current flow through the ballast, thereby causing a large voltage spike to develop. Due to the circuit topology, this large voltage is present between the two filaments. The voltage is large enough to strike an arc through the gas. Once the arc is established, the resistance between the two filaments through the gas decreases. This allows the current to continue to flow through the gas without a large voltage being present between the filaments. The switch is left open, the current continues to flow, filaments continue to be heated, the arc is maintained, and the current flow is regulated by the ballast. The fluorescent lamp is then on and emits visible light to illuminate an area.

In fluorescent light fixtures, the starter may fail. The starter is therefore sometimes made to be a replaceable unit. Great numbers of fluorescent light fixtures with replaceable starter units are installed throughout the world. Large numbers of such fluorescent light fixtures are installed in public buildings, office buildings, and other large buildings. Quite often the fluorescent lights are left on and consume electrical energy even though the area served does not need to be illuminated. A way of preventing this waste of electrical energy is desired.

Infrared motion detecting wall switches are often employed to prevent the waste of energy due to lights being left on when lighting is not needed. If an infrared motion detector in the wall switch does not detect motion of an infrared emitter (for example, a human body) in the vicinity of the wall switch, then circuitry in the wall switch determines that the room is not occupied by a person. Presumably if a person were in the room, the person would be moving to some extent and would be detected as a moving infrared emitter. If the wall switch determines that the room is unoccupied because it does not detect any such moving infrared emitter, then the wall switch turns off the fluorescent lights on the circuit controlled by the wall switch. The wall switch turns off the fluorescent lights by cutting AC power flowing to the fluorescent lamp light fixtures through power lines hardwired into the building. If, however, the wall switch detects a moving infrared emitter, then the wall switch turns on the lights by energizing the hardwired power lines so that AC power is supplied to the fluorescent light fixtures through the hardwired power lines.

The wall switch motion detection system involving hardwired power lines embedded in the walls and ceilings of buildings is quite popular, but a wireless system has been proposed whereby each of the replaceable starter units is to be provided with an RF receiver. The starter unit is then to turn on or off the fluorescent lamp of its light fixture in response to RF commands received from a central motion detecting occupancy detector. Turning off a fluorescent lamp using a starter unit instead of a wall switch, however, sometimes does not work because the lamp re-ignites. A system is sought in which a starter unit can reliably turn off a fluorescent lamp without using a wall switch.

SUMMARY

A method determines a local minimum of a current monitoring signal in a starter unit that turns off a fluorescent lamp without using a wall switch. An illuminating current is stopped from flowing through a gas in the lamp by closing a main switch in the starter unit. The current monitoring signal provides an indication of the current flowing through the main switch. The method determines that a local minimum of the current monitoring signal has been reached by identifying a valid increasing sample of the signal after finding a sliding window of four valid samples. A sample is valid if it does not differ from the last valid sample by more than a threshold difference based on the known properties of the current monitoring signal. By rejecting and skipping over invalid samples, the local minimum of the current monitoring signal is accurately determined to have been reached despite transient noise spikes in the signal that would likely trip a voltage threshold used to locate the local minimum. The main switch is then opened after a predetermined time interval after the local minimum is determined to have been reached. The lamp is not re-ignited when the main switch is opened because the illuminating current does not begin to flow again through the gas.

The sliding sample window method can be used to turn off fluorescent lamps that are associated with both inductive-type ballasts and capacitive-type ballasts. When turning off a lamp with a capacitive-type ballast, the predetermined time interval is chosen such that the main switch is opened as the current monitoring signal approaches a local maximum. When turning off a lamp with an inductive-type ballast, the predetermined time interval is zero such that the main switch is opened as soon as possible after the local minimum.

One embodiment of the sliding sample window method involves closing the main switch of the starter unit to stop the illuminating current from flowing through the gas of the fluorescent lamp. A first magnitude of a current monitoring waveform is determined at a first time. A second magnitude of the waveform is then determined at a second time that occurs after the first time. Then a third magnitude of the waveform is determined at a third time that occurs after the second time. A first difference between the third magnitude and the second magnitude is determined, and a threshold difference for the waveform between the second time and the third time is determined. The threshold difference is determined based on the known typical characteristics of the ideal waveform. For example, it is known that the amplitude of the ideal waveform does not change by more than a certain percentage within a certain time period. The third magnitude is a valid sample if the first difference is smaller than the threshold difference. Samples that are not valid are skipped. By skipping over invalid samples, the local minimum of the waveform is accurately determined to have been reached despite transient noise spikes in the waveform that are themselves local minima at a higher frequency than the periodic cycles of the waveform. If the first difference is smaller than the threshold difference, the third magnitude is then compared to the first magnitude. A local minimum of the waveform is determined to have been reached if the third magnitude exceeds the first magnitude. If the local minimum of the waveform has been reached, the switch is opened at a predetermined time interval after the third time, and the lamp does not re-ignite.

In another embodiment of the sliding sample window method, an illuminating current is stopped from flowing through the gas of a fluorescent lamp by closing a main switch of a starter unit. Samples of a shunt current that flows through the main switch are taken when the switch is closed and the samples of the shunt current are decreasing. The switch is then opened at a predetermined time interval after the samples of the shunt current first begin to increase after the samples of the shunt current are decreasing. For a fluorescent lamp with an inductive-type ballast, the predetermined time interval is zero such that the switch is opened as soon as possible after the samples of the shunt current first begin to increase. For a fluorescent lamp with a capacitive-type ballast, the predetermined time interval is chosen such that the switch is opened as the shunt current waveform approaches a local maximum.

An apparatus includes a fluorescent lamp, a ballast and a means for opening a switch at a certain time. The fluorescent lamp is coupled to the ballast, and the ballast is adapted to receive an alternating current from an AC line voltage supply. The alternating current flows through the switch when the switch is closed, and flows through a gas of the fluorescent lamp when both the switch is open and the fluorescent lamp is on. The means opens the switch when a predetermined time interval elapses following a local minimum of the waveform of the alternating current by determining when samples of the alternating current begin to increase. The means also stops the alternating current from flowing through the gas without disconnecting the AC line voltage supply from the fluorescent lamp. The means determines the local minimum of the waveform despite the waveform exhibiting transient noise spikes within a quarter cycle of the waveform before and after the local minimum. For an inductor-type ballast, the predetermined time interval is less than one quarter of a cycle of the waveform. For an inductive-type ballast, the predetermined time interval is between one quarter and one half of a cycle of the waveform.

Further details and embodiments and techniques are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

FIGS. 17A-B shows source code that implements the sliding sample window method of finding a local minimum of the current monitoring signal of FIG. 13-14.

DETAILED DESCRIPTION

Reference will now be made in detail to background examples and some embodiments of the invention, examples of which are illustrated in the accompanying drawings.

Figure 1:
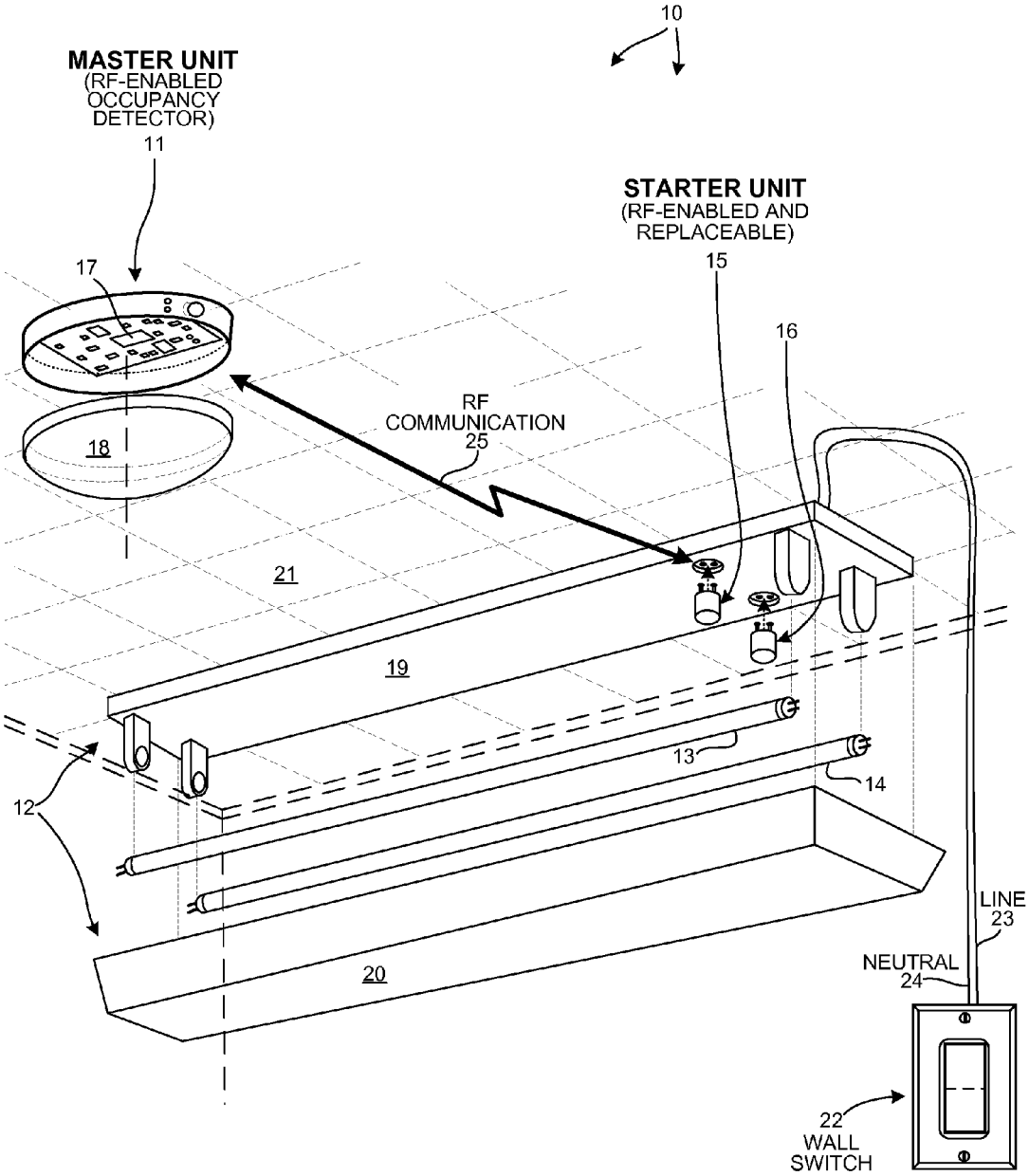
FIG. 1 is a simplified perspective diagram of a system for turning off fluorescent lamps that includes a master unit and a fluorescent light fixture with replaceable RF-enabled starter units.

FIG. 1 is a diagram of a system 10 for turning off a fluorescent lamp that includes a master unit 11 and a plurality of multi-lamp fluorescent light fixtures having fluorescent lamp starter units. For illustrative purposes, one multi-lamp fluorescent light fixture 12 is pictured in FIG. 1. Other multi-lamp fluorescent light fixtures of system 10 are not pictured. Multi-lamp fluorescent light fixture 12 includes two fluorescent lamps 13 and 14 and starter units 15 and 16 associated with each lamp, respectively. In this example, master unit 11 is an infrared occupancy detector involving a Passive InfraRed (PIR) sensor 17 and a multi-section fresnel lens 18. Using techniques well known in the art, master unit 11 detects motion of infrared emitters in the field of view of fresnel lens 18 and detects the lack of motion of such infrared emitter. If the master unit detects motion, then the master unit turns on or keeps on the fluorescent lamps of the fluorescent light fixtures of system 10. If, on the other hand, the master unit does not detect motion, then the master unit turns off the fluorescent lamps of system 10 to conserve electrical energy. In another example, master unit 11 includes an ambient light detector useable to indicate available ambient light. Based on the available ambient light, the master unit may turn off fluorescent lamps of the multi-lamp fixture 12 of system 10 to conserve electrical energy. In the illustration of FIG. 1, multi-lamp light fixture 12 includes a base portion 19, a translucent cover portion 20, the fluorescent bulbs or lamps 13-14, and their associated starter units 15-16, respectively. Ballasting inductances (not shown) are included with fluorescent lamps 13-14. Both the multi-lamp light fixture 12 and the master unit 11 are fixed to the ceiling 21 of a room in a building as shown. A wall switch 22 is connected by electrical wires 23-24 to all the light fixtures of system 10 in standard fashion so that a person in the room can manipulate the wall switch to turn on, and to turn off, the fluorescent lights. The electrical wires 23-24 are embedded in the walls and ceiling of the building. In the illustrated example, wire 23 is the LINE conductor, whereas wire 24 is the NEUTRAL conductor.

Master unit 11 has a radio-frequency (RF) transceiver (transmitter and receiver) for engaging in RF communication, including an RF communication 25 with the starter units 15-16 of system 10. As pictured, master unit 11 need not be connected to any hardwired electrical wiring in the building. The master unit 11 is a self-contained, battery-powered unit that is fixed to the ceiling 21 of the room illuminated by system 10. Master unit 11 can be easily fixed to ceiling 21 by application of adhesive tape or by a screw or other common attachment mechanism. Each fluorescent light fixture of system 10 includes a replaceable starter unit. Starter unit 15 pictured in FIG. 1 is one example.

Figure 2:
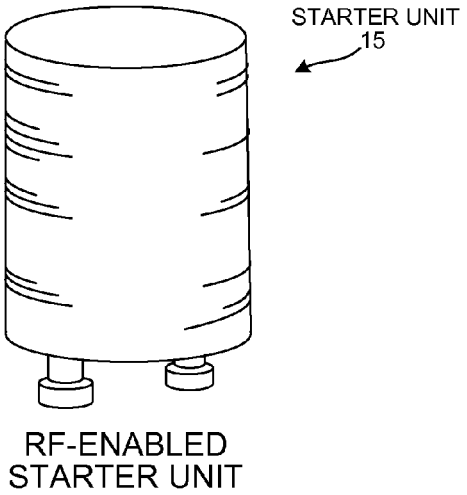
FIG. 2 is a perspective view of one of the RF-enabled starter units of FIG. 1.

FIG. 2 is a perspective view of starter unit 15.

Figure 3:
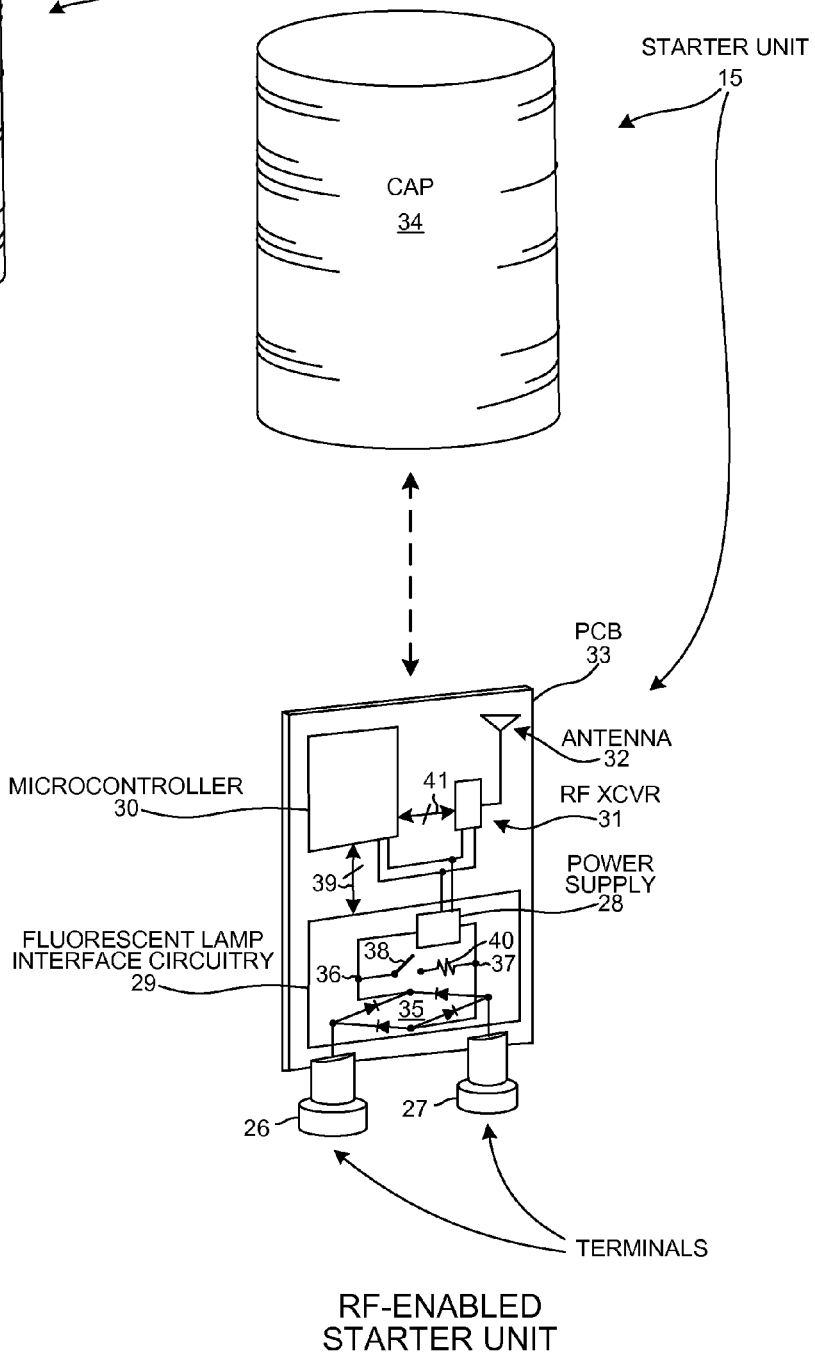
FIG. 3 is an exploded perspective view of the RF-enabled starter unit of FIG. 2.

FIG. 3 is an exploded perspective view of starter unit 15. Starter unit 15 includes a first terminal 26, a second terminal 27, a power supply 28, fluorescent lamp interface circuitry 29, a microcontroller integrated circuit 30, an RF transceiver 31 and an antenna 32. This circuitry is disposed on a printed circuit board (PCB) 33 as illustrated. PCB 33 is disposed within a cylindrical cap 34. Terminals 26-27 extend downward through holes in a circular disk-shaped base portion (not shown) of PCB material. The circular edge of this disk-shaped base portion joins with the circular bottom edge of cap 34 and forms a circular bottom of starter unit 15.

Fluorescent lamp interface circuitry 29 includes a full wave rectifier 35 that receives a 230-volt alternating-current (AC) signal between terminals 26 and 27 and outputs a full wave rectified signal (VRECT) between nodes 36 and 37. Power switch 38 is a switch that is used to turn on, and to turn off, fluorescent lamp 13. Power switch 38 is a power field effect transistor (FET) that is controlled by microcontroller 30 via gate drive circuitry of circuitry 29. Microcontroller 30 drives the gate of switch 38 and controls and monitors the remainder of interface circuitry 29 via signals communicated across conductors 39. Microcontroller 30 monitors and traces the alternating current and voltage waveforms between nodes 36 and 37 using an analog-to-digital converter (ADC) that is part of the microcontroller. Microcontroller 30 monitors and traces the waveform of the current flowing through switch 38 by using its ADC to monitor a voltage dropped across a sense resistor 40. Microcontroller 30 uses an on-board comparator and a timer to detect and time zero-crossings and minima of the AC signals on nodes of the circuitry 29. Microcontroller 30 determines when and how to control switch 38 based on the detected voltage and current between nodes 36 and 37, the time of the zero-crossings of the AC signal on terminals 26-27, and the magnitude of current flowing through switch 38.

Power supply 28 receives the full wave rectified signal between nodes 36 and 37 and generates therefrom a direct current (DC) supply voltage VDD used to power microcontroller 30, RF transceiver 31, and interface circuitry 29. Power supply 28 includes a capacitance that is charged to the DC supply voltage VDD. This capacitance is large enough that it continues to power the microcontroller and RF transceiver of the starter unit for more than five seconds after the 230-volt AC power is removed from terminals 26-27. If the starter unit 15 is installed in light fixture 12, and if wall switch 22 is toggled on and off faster than once every five seconds, then interface circuitry 29, microcontroller 30, and transceiver 31 remain powered and operational.

Microcontroller 30 communicates with and controls RF transceiver 31 via a bidirectional serial SPI bus and serial bus conductors 41. In one embodiment, microcontroller 30 is a Z8F2480 8-bit microcontroller integrated circuit available from Zilog, Inc., 6800 Santa Teresa Blvd., San Jose, Calif. 95119. Microcontroller 30 includes an amount of non-volatile memory (FLASH memory) that can be written to and read from under software control during operation of starter unit 15. In one embodiment, RF transceiver 31 is a SX1211 transceiver integrated circuit available from Semtech Corporation, 200 Flynn Road, Camarillo, Calif. 93012. Transceiver 31 is coupled to antenna 32 via an impedance matching network (not shown) and a SAW filter (not shown). The SAW filter may, for example, be a B3716 SAW filter available from the Surface Acoustic Wave Components Division of EPCOS AG, P.O. Box 801709, 81617 Munich, Germany. Antenna 32 may, for example, be a fifty ohm 0868AT43A0020 antenna available from Johanson Technology, Inc., 4001 Calle Tecate, Camarillo, Calif. 93012. RF transceiver 31 operates in a license free frequency band in the 863-878 MHz range (for example, about 868 MHz), in accordance with a reference design available from Semtech Corporation. The RF antenna and transceiver of starter unit 15 can receive an RF communication 25 (see FIG. 1) from master unit 11. The data payload of the communication 25 is communicated across SPI bus conductors 41 to microcontroller 30 for processing.

Figure 4:
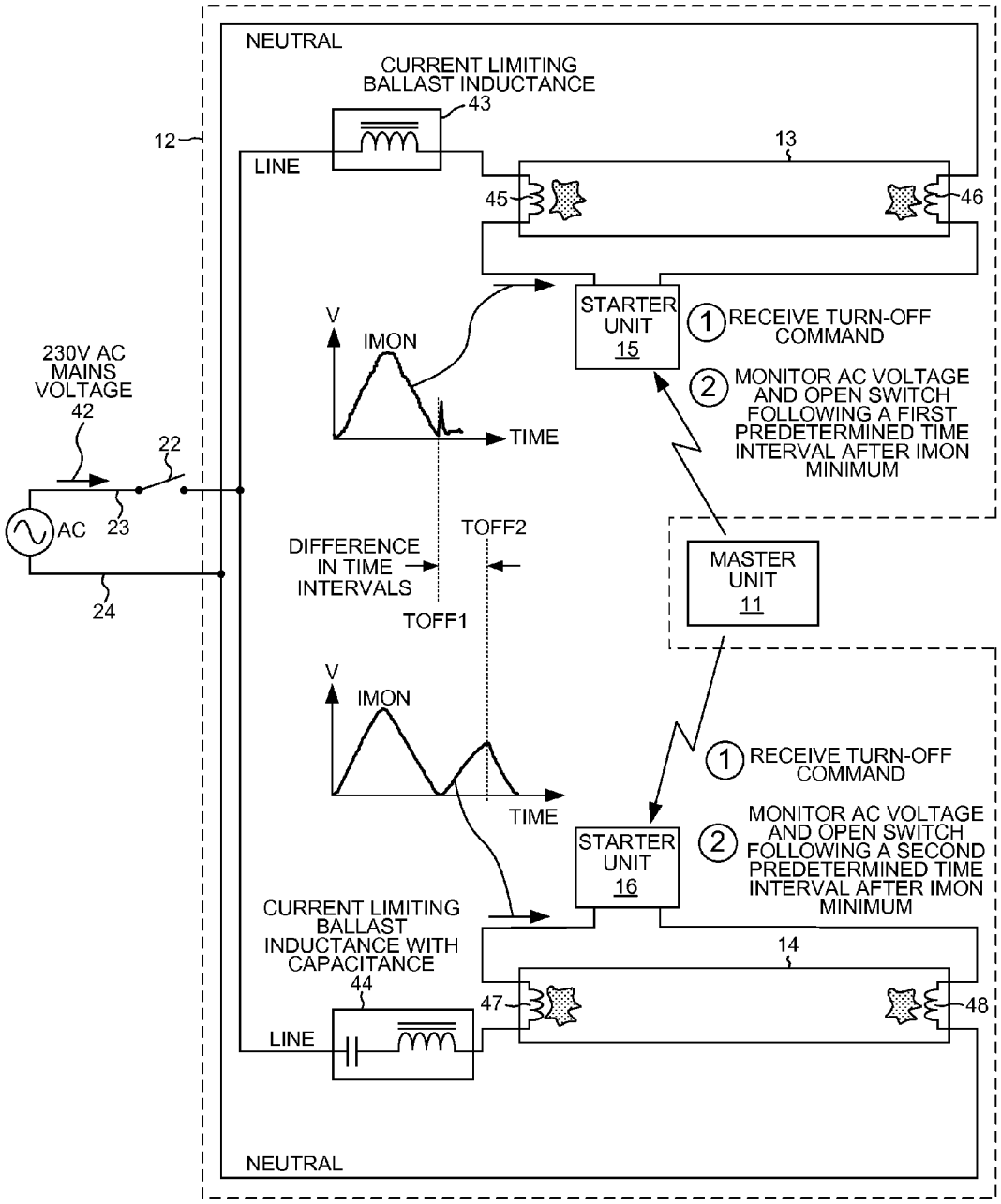
FIG. 4 is a more detailed circuit view of the system of FIG. 1 for turning off fluorescent lamps.

FIG. 4 is a more detailed circuit view of system 10. In one example, a 230-volt, 60-Hz alternating current (AC) mains voltage 42 is the line voltage supplied to fluorescent light fixture 12. The line voltage is supplied over LINE conductor 23 through wall switch 22. A neutral voltage return path is provided by NEUTRAL conductor 24. Light fixture 12 can be electrically disconnected from the AC MAINS voltage supply 42 by manipulation of wall switch 22. In various embodiments, light fixture 12 can have an inductance-type ballast, a capacitance-type ballast or multiple lamps with the same or different types of ballasts. The embodiment of FIG. 4 includes a lamp 13 with an associated inductance-type ballast 43, as well as a second lamp 14 with an associated capacitance-type ballast 44. The AC MAINS voltage is supplied to both ballasts 43 and 44. Ballast 43 supplies current to fluorescent lamp 13 when lamp 13 is turned on. While turned on, current flows from ballast 43, through a filament 45, over an electrical arc to a filament 46, and back to the AC MAINS voltage supply 42 via NEUTRAL conductor 24. Similarly, ballast 44 supplies current to fluorescent lamp 14 when lamp 14 is turned on. While turned on, current flows from ballast 44, through a filament 47, over an electrical arc to a filament 48, and back to the AC MAINS voltage supply 42 via NEUTRAL conductor 24.

FIG. 4 illustrates how lamps 13-14 are turned off by starter units 15-16 without using wall switch 22. When lamps 13-14 are turned off by motion sensors in master unit 11, light fixture 12 remains electrically connected to AC MAINS voltage supply 42 through wall switch 22. When starter unit 15 receives a turn off command from master unit 11, starter unit 15 begins to monitor various signals within interface circuitry 29. Microcontroller 30 monitors whether a zero crossing event has occurred by determining that the amplitude of a zero crossing signal (ZXMON) has dropped sharply from a higher voltage to a lower voltage so as to resemble a digital "falling edge." About 2.5 milliseconds (ms) after the "falling edge" of the ZXMON signal is detected, switch 38 is closed.

When switch 38 is closed, current from AC MAINS voltage supply 42 flows through switch 38 and stops flowing through the gas in lamp 13, and lamp 13 stops illuminating. Switch 38 will burn out, however, if it remains closed indefinitely. So switch 38 is soon opened at a point in the current waveform flowing through ballast 43, filaments 45-46 and switch 38 that will not re-ignite the gas in lamp 13. About 5 ms after switch 38 is closed, microcontroller 30 begins to monitor the current flowing through switch 38 by tracing the voltage amplitude dropped across current sense resistor 40. The voltage amplitude across current sense resistor 40 is indicated by a current monitoring signal (IMON). Starter unit 15 determines when a local minimum of the current monitoring signal IMON occurs, and then opens switch 38 a predetermined time interval after the local minimum has occurred so that the gas in lamp 13 does not re-ignite.

The predetermined time interval that starter units 15 and 16 wait from the local minimum until opening switch 38 is different for an inductance-type ballast and a capacitance-type ballast. Switch 38 is opened when the amount of energy stored in the ballast is at a minimum so that a surge in voltage from the ballast upon opening switch 38 will not re-ignite the gas between the filaments and turn the lamp back on.

The voltage across inductive ballast 43 is a minimum when the first derivative of the current waveform flowing through inductive ballast 43 is zero at a local minimum. [$V=L(dI/dT)=0$ when $dI/dT=0$] Although the voltage across inductive ballast 43 is also zero at a local maximum, the energy stored in inductive ballast 43 is at a minimum at a local minimum of the current waveform. Consequently, starter unit 15 opens switch 38 near the local minimum, and the predetermined time interval is zero or near zero.

The inductive component of ballast 43 performs a current limiting function to stabilize current flow through lamp 13. Similarly, ballast 44 also has an inductive component to stabilize current flow through lamp 14. In addition, however, ballast 44 also includes a capacitive component for purposes of power factor correction as is well known in the art. The LC tank of ballast 44 stores energy in a different manner than the lone inductor of ballast 43. The point in the current waveform flowing through switch 38 at which the energy stored in ballast 44 is at a minimum is phase shifted from the point of minimum energy of ballast 43. It was empirically determined that the energy in capacitive-type ballast 44 is at a minimum when the current monitoring signal IMON approaches a local maximum. For a 60-Hz AC mains power signal that is rectified by rectifier 35 into a 120-Hz rectified voltage signal (VRECT), the local minima of the current monitoring signal IMON are 8.33 ms apart, and the predetermined time interval after a local minimum at which switch 38 is opened is about 4.0 ms. FIG. 4 illustrates that switch 38 of starter unit 15 is opened at time TOFF1 soon after the local minimum of the IMON signal is reached, whereas switch 38 of starter unit 16 is opened at time TOFF2 a predetermined time interval after the local minimum of the IMON signal is reached and as the IMON signal approaches a local maximum.

The difference in reactance between ballasts 43 and 44 causes an overall phase shift between the AC voltage supplied to fluorescent lamp 13 and the AC voltage supplied to fluorescent lamp 14. Based on this phase shift, the predetermined time intervals after the local minima of the IMON signals are adjusted such that the switches 38 of starter units 15-16 are opened closer to the same time in order to reduce the probability that one lamp will re-ignite the other due to electromagnetic coupling effects. In one embodiment, the first predetermined time interval at which switch 38 is opened after a local minimum of the IMON signal through starter unit 15 and the second predetermined time interval at which switch 38 is opened after a local minimum of the IMON signal through starter unit 16 are adjusted such that the switches 38 of starter units 15-16 are opened within one millisecond of each other.

For additional details on how starter units turn off fluorescent lamps without using a wall switch, see U.S. patent application Ser. No. 12/587,152 entitled "Registering A Replaceable RF-Enabled Fluorescent Lamp Starter Unit To A Master Unit," filed on Oct. 1, 2009, U.S. patent application Ser. No. 12/587,130 entitled "Turning Off Multiple Fluorescent Lamps Simultaneously Using RF-Enabled Lamp Starter Units," filed on Oct. 3, 2009, and U.S. patent application Ser. No. 12/587,169 entitled "Dimming A Multi-Lamp Fluorescent Light Fixture By Turning Off An Individual Lamp Using A Wireless Fluorescent Lamp Starter," filed on Oct. 3, 2009. The subject matter of all three patent documents is incorporated herein by reference.

Figure 5:
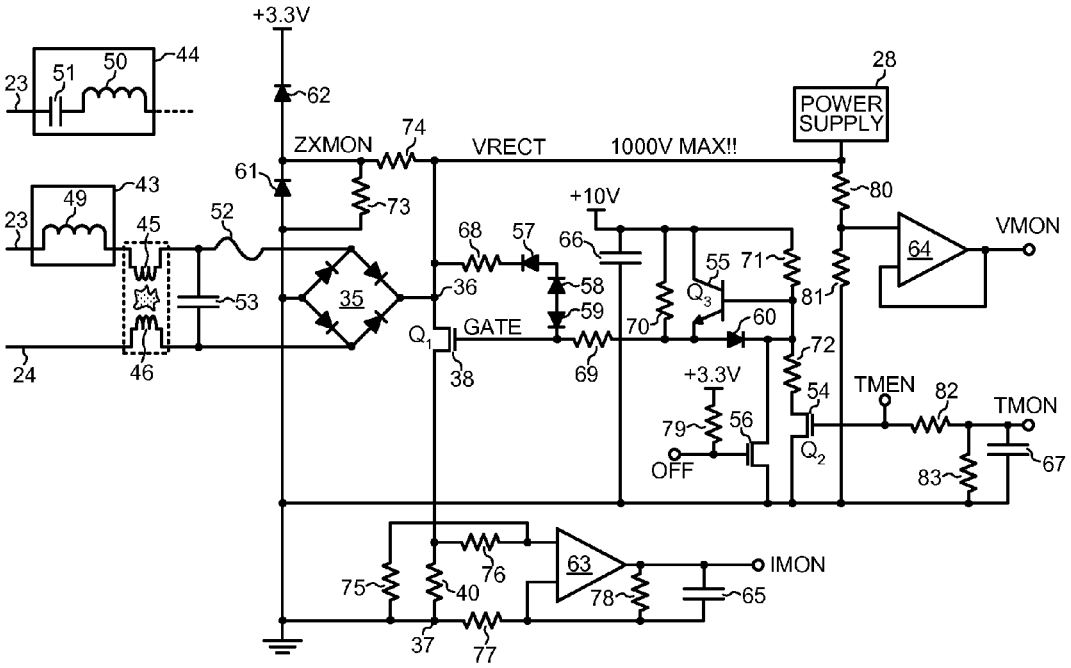
FIG. 5 is a more detailed circuit diagram of the circuitry of the starter unit of FIG. 2.

FIG. 5 is a more detailed diagram of a portion of the circuitry of starter unit 15. A more detailed explanation of how lamp 13 is turned on and off is now provided with reference to FIG. 5. FIG. 5 shows that inductive-type ballast 43 coupled to starter unit 15 includes an inductor 49. Starter unit 16 has circuitry analogous to that of starter unit 15 except that start unit 16 is coupled to capacitive-type ballast 44. FIG. 5 shows that ballast 44 includes an inductor 50 as well as a capacitor 51. Starter unit 15 includes a thermal fuse 52 and a capacitor 53 coupled between filaments 45-46 of lamp 13 and rectifier 35. In addition to main switch 38 (Q1), starter unit 15 has at least three other switches 54-56. In addition to the four diodes in rectifier 35, starter unit 15 has at least six other diodes 57-62. In addition to capacitor 53, starter unit 15 includes at least three other capacitors 65-67. In addition to current sense resistor 40, starter unit 15 includes various other resistors 68-83. Starter unit 15 also includes two comparators 63-64.

In an initial condition when lamp 13 is off, switch 38 of starter unit 15 is open, and no current is flowing through filaments 45-46. The filaments 45-46 are relatively cold. Microcontroller 30 then controls switch 38 to close by deasserting an OFF signal present on one of the pins of the microcontroller. The node on which the OFF signal is present is illustrated in FIG. 5. Deasserting the OFF signal opens switch 56, which drives a GATE signal present on the gate of main switch 38 high. When the GATE signal is asserted, main switch 38 closes and the current flowing through switch 38 also flows through filaments 45-46. The AC current flows through LINE conductor 23, through inductor 49, through filament 45, through rectifier 35, through closed switch 38, back through rectifier 35, through filament 46, and to NEUTRAL conductor 24. This AC current flow causes filaments 45-46 to heat, and causes gas in lamp 13 to ionize. This current flow through switch 38 can only be sustained for a relatively short amount of time or else switch 38 will overheat and be destroyed. Accordingly, after about one second, switch 38 is opened. When the current flowing through inductor 49 is interrupted, a large voltage develops across inductor 49, for example, one thousand volts or more. Due to switch 38 being open, a large voltage develops between the two filaments 45-46 that ignites the lamp by causing an arc to form through the gas in lamp 13. The arc causes the resistance between the filaments and through the lamp to decrease such that the current continues to flow between the filaments and keeps the filaments hot. The fluorescent lamp 13 is then on, and switch 38 remains open.

Figure 6:
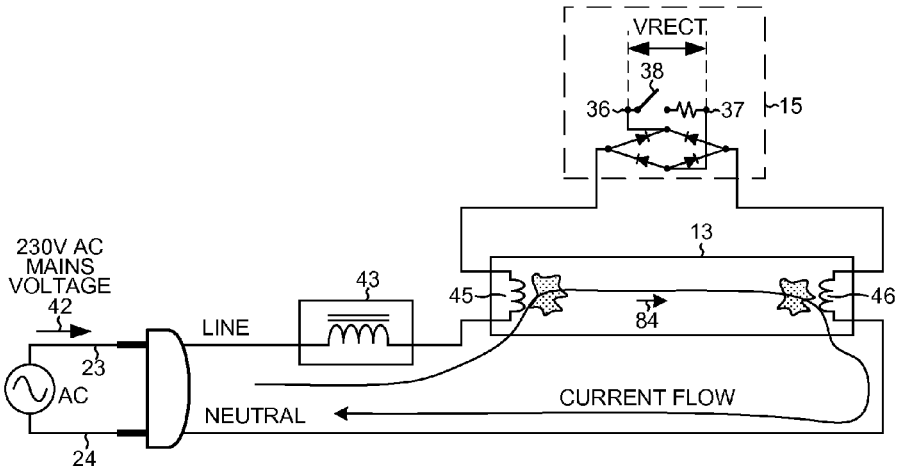
FIGS. 6-7 and 9-10 are circuit diagrams that illustrate how the starter unit of FIG. 2 can turn off a fluorescent lamp.
Figure 7:
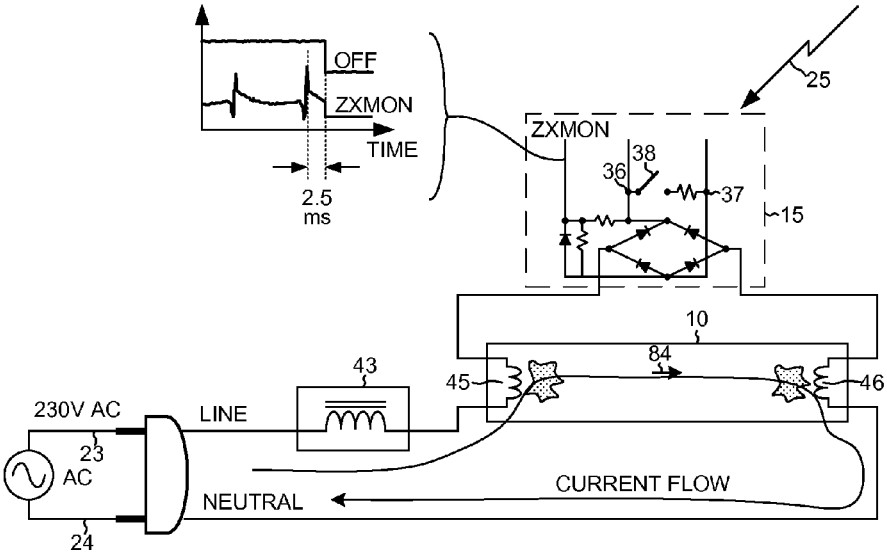
Figure 8:
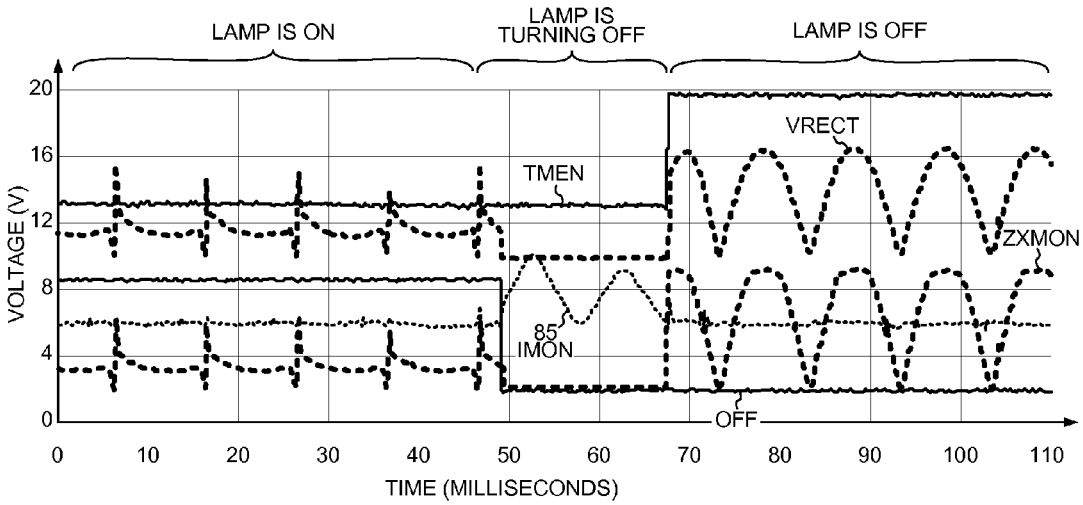
FIGS. 8 and 11 are waveform diagrams that illustrate waveforms on certain nodes of the circuits of FIGS. 6-7 and 9-10.
Figure 9:
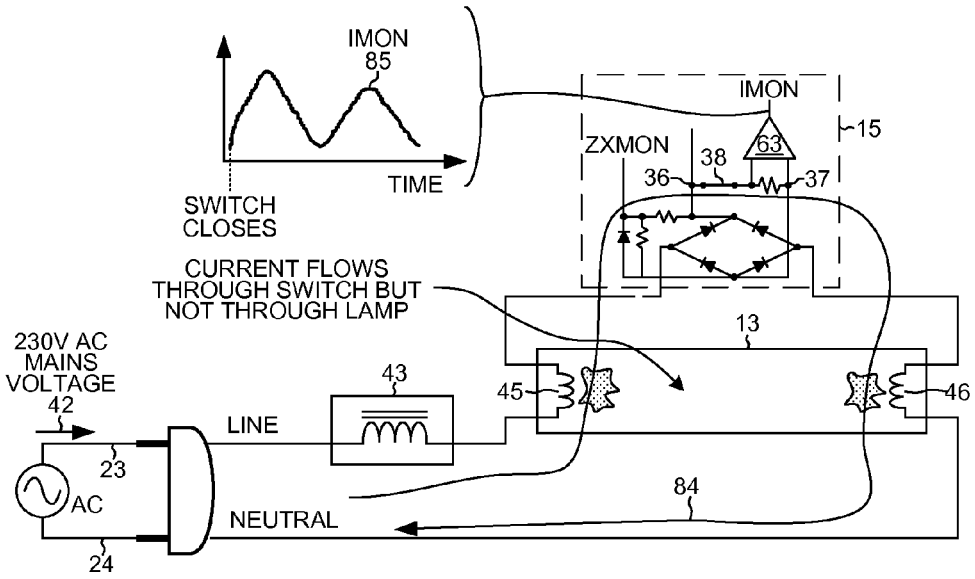
Figure 10:
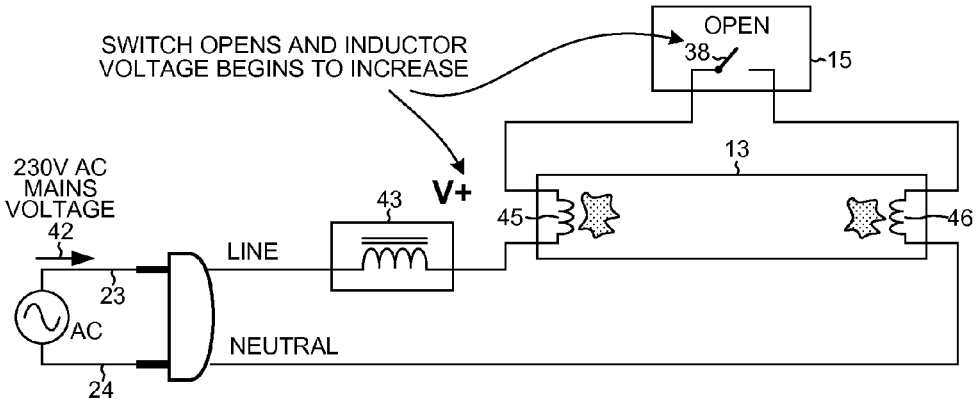
Figure 11:
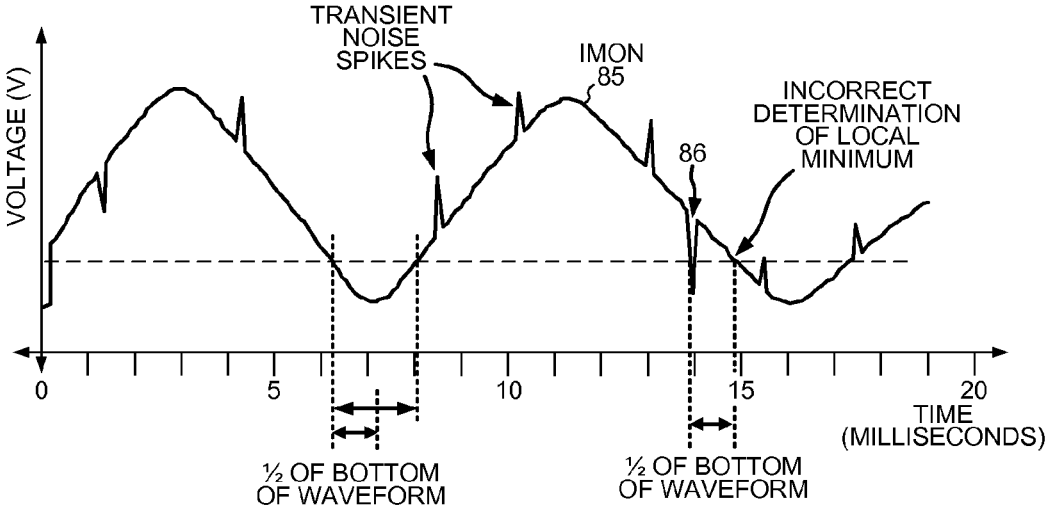

FIGS. 6-11 illustrate in more detail how starter unit 15 turns off fluorescent lamp 13. In a manner analogous to that used by starter unit 15, starter unit 16 turns off fluorescent lamp 14. FIGS. 6-7 and 9-10 are simplified circuit diagrams, whereas FIGS. 8 and 11 are waveform diagrams of waveforms on certain nodes of the circuit diagrams. In FIG. 6, fluorescent lamp 13 is on, switch 38 is open, and the AC current flows in current path 84 through LINE conductor 23, through ballast 43, through filament 45, through an arc formed through lamp 13, through filament 46, and to NEUTRAL conductor 24. The continuous AC current flow continues to keep the filaments hot such that the arc is maintained, the current flow continues, and the lamp remains in a turned on state. During this turned on state, switch 38 remains open.

As illustrated in FIG. 7, starter unit 15 receives a wireless communication 25 that includes a turn off command. In one example, wireless communication 25 is transmitted by master unit 11 (see FIG. 1). In response to receiving wireless communication 25, starter unit 15 begins to monitor the zero crossing signal (ZXMON) present on the node in FIG. 5 between diodes 61 and 62. Microcontroller 30 determines when the amplitude of the ZXMON signal has dropped sharply from a higher voltage to a lower voltage so as to resemble a digital "falling edge." About 2.5 ms after the "falling edge" of the ZXMON signal is detected, microcontroller 30 deasserts the OFF signal, which causes switch 38 to close. When the AC current flows through the closed switch 38, the waveforms of the ZXMON signal between diodes 61 and 62 and a rectified voltage signal (VRECT) on node 36 collapse.

FIG. 8 is a waveform diagram illustrating the ZXMON signal, the OFF signal, the VRECT signal, a TMEN signal and a current monitoring signal (IMON) 85 during the time period when lamp 13 is being turned off. The IMON signal 85 is generating using current sense resistor 40 and comparator 63 and represents the magnitude of the current flowing through main switch 38. FIG. 8 illustrates how the OFF signal is deasserted about 2.5 ms after a spike in the ZXMON signal.

FIG. 9 shows the AC current beginning to flow through switch 38 when the OFF signal is deasserted and the GATE signal is asserted, closing switch 38. When switch 38 closes, current flows through switch 38 and stops flowing through lamp. The arc through the gas in lamp 13 is stopped. Current continues to flow, however, through filaments 45-46, and the filaments continue to be heated. Switch 38 can only remain closed in this condition for a short amount of time as explained above or the switch will become overheated and will be destroyed. Microcontroller 30 monitors the IMON signal 85 to determine when the current flowing through switch 38 is at a minimum. Microcontroller 30 monitors the current flowing through switch 38 by tracing the IMON signal using an analog-to-digital converter (ADC) that is part of microcontroller 30.

FIG. 10 illustrates how switch 38 is opened a predetermined time interval after the IMON signal 85 reaches a local minimum and the energy stored in inductive-type ballast 43 is at a minimum. When microcontroller 30 determines that a local minimum of the IMON signal 85 has been reached, microcontroller 30 opens switch 38 by asserting a signal TMEN present on one of the pins of the microcontroller. In one embodiment, the TMEN signal is a dual-purpose signal that is also used to enable a temperature measurement function of starter unit 15. Asserting the TMEN signal deasserts the GATE signal, opens switch 38 and stops current from flowing through ballast 43. But cutting the current flowing through inductor 49 of ballast 43 causes a voltage to develop across inductor 49. By cutting the current near to a local minimum of the IMON signal 85 when the magnitude of the alternating current flowing through switch 38 has stopped changing, the magnitude of any voltage spike from the collapsing magnetic field around inductor 49 can be limited so that no arc is generated that re-ignites the gas in lamp 13. In addition, switch 38 is made to operate as a voltage clamp to limit the magnitude of any voltage spike. The clamping operation is performed by diodes 57-59 and resistor 68 shown in FIG. 5. Due to the clamping action of switch 38 and opening switch 38 near when the least amount of energy is stored in inductive-type ballast 43, the voltage across inductor 49 is not high enough to re-ignite an arc through lamp 9, and the energy stored in the magnetic field around inductor 49 is dissipated.

After enough of the energy stored in inductor 49 has been dissipated and after filaments 45-46 have stopped ionizing gas to an adequate , then the clamping operation ceases and switch 38 is opened on a constant basis without igniting an arc. There is no current flow through either lamp 13 or starter unit 15, and the filaments 45-46 begin to cool. Fluorescent lamp 13 is then said to be in the off condition.

But even when switch 38 is opened at the bottom of the IMON waveform for an inductive-type ballast or near a peak of the IMON waveform for a capacitive-type ballast, the lamps 13-14 sometimes re-ignite. A problem has been recognized that the lamps re-ignite when the local minima of the IMON waveform is inaccurately determined due to transient noise spikes in the waveform. Where the electric utility company generates 230-volt AC MAINS voltage 42 with transient noise spikes, the noise spikes pass through rectifier 35 and appear as noise spikes on the IMON waveform. Where a local minimum of IMON signal 85 is determined by when the IMON waveform passes below a low voltage threshold, a low-voltage spike sometimes passes the threshold before the actual waveform would pass the threshold and results in a premature threshold crossing indication.

FIG. 11 illustrates one method of determining a local minimum of IMON signal 85. A comparator is used to determine when the decreasing voltage magnitude of the IMON waveform first passes below a threshold voltage set toward the bottom of the waveform. Then a timer in microcontroller 30 times the period elapsed until the IMON waveform passes back above the threshold voltage. The bottom of each cycle of the IMON waveform is assumed to be symmetrical about the each local minimum. The next local minimum is calculated to occur at one half of the measured time period after the IMON waveform next passes below the voltage threshold. This threshold method of determining when local minima of the IMON waveform occur, however, returns incorrect results if transient voltage spikes are present around the local minima. FIG. 11 shows that a transient voltage spike 86 on the IMON waveform would pass below the voltage threshold and cause the timer in the threshold method prematurely to begin counting off one half of the period of the bottom of the IMON waveform. In the presence of spike 86, the threshold method would cause switch 38 to be opened while the ballasts 43-44 still contain significant energy. It has been determined that opening switch 38 at a time other than at a local minimum of the IMON signal 85 in a lamp with an inductive-type ballast can cause the lamp to reignite. For a 230-volt 60-Hz AC input voltage, it has been empirically determined that opening switch 38 at a time other than about 4.3 ms after a local minimum of the IMON signal 85 in a lamp with a capacitive-type ballast not only can cause the lamp to re-ignite, but also can burn through switch 38.

A novel method for determining the location of a local minimum of a current monitoring signal in starter unit 15 uses a sliding window of samples as opposed to a threshold. A local minimum of the IMON signal 85 is determined to have occurred when the magnitude of a fifth sample is larger than the magnitude of a first sample of the sliding window of samples. Samples within the sliding window are rejected if their magnitudes differ from those of the preceding samples by amounts larger than would correspond to the predetermined slope of the IMON signal 85.

Figure 12:
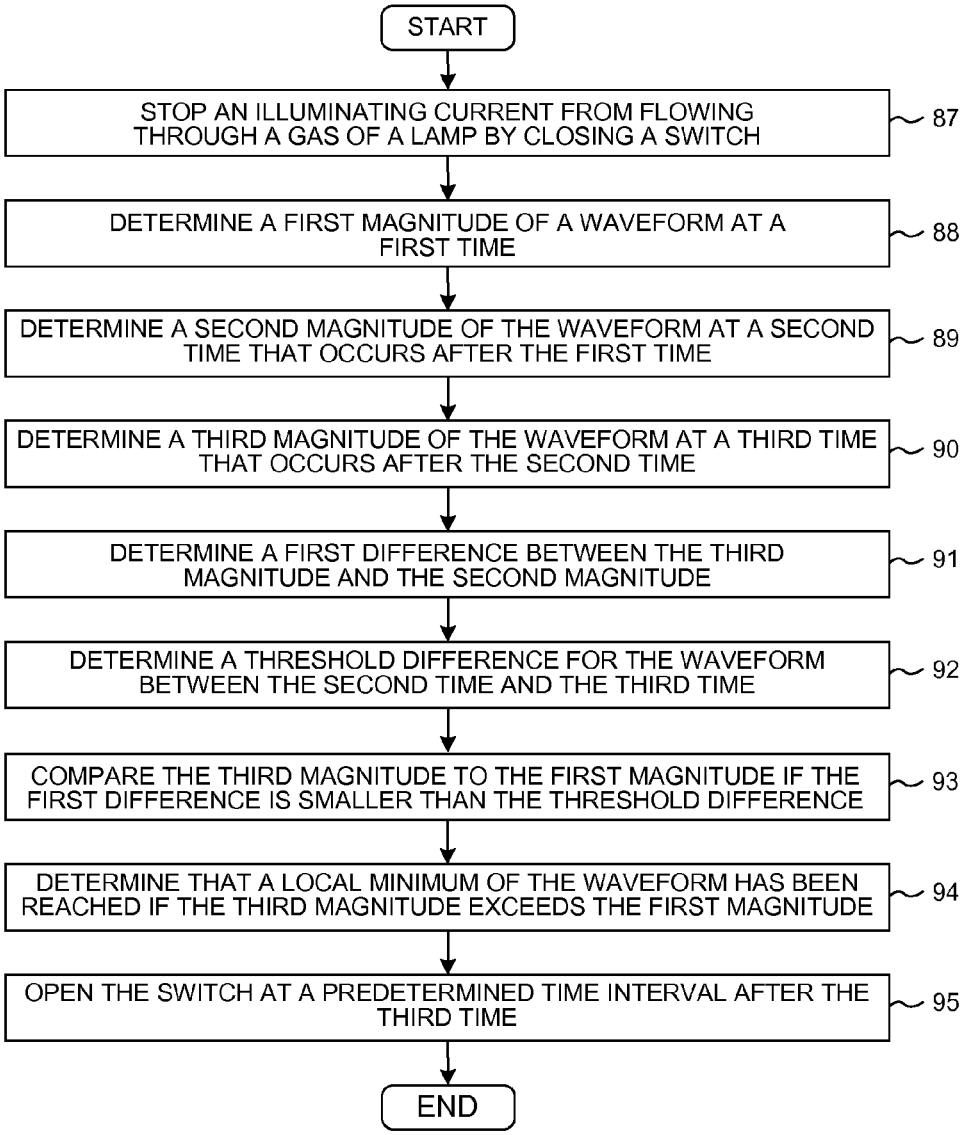
FIG. 12 is a flowchart of steps of a method for turning off a fluorescent lamp by opening a main switch in a starter unit at an appropriate time based on a local minimum of a current monitoring signal.
Figure 13:
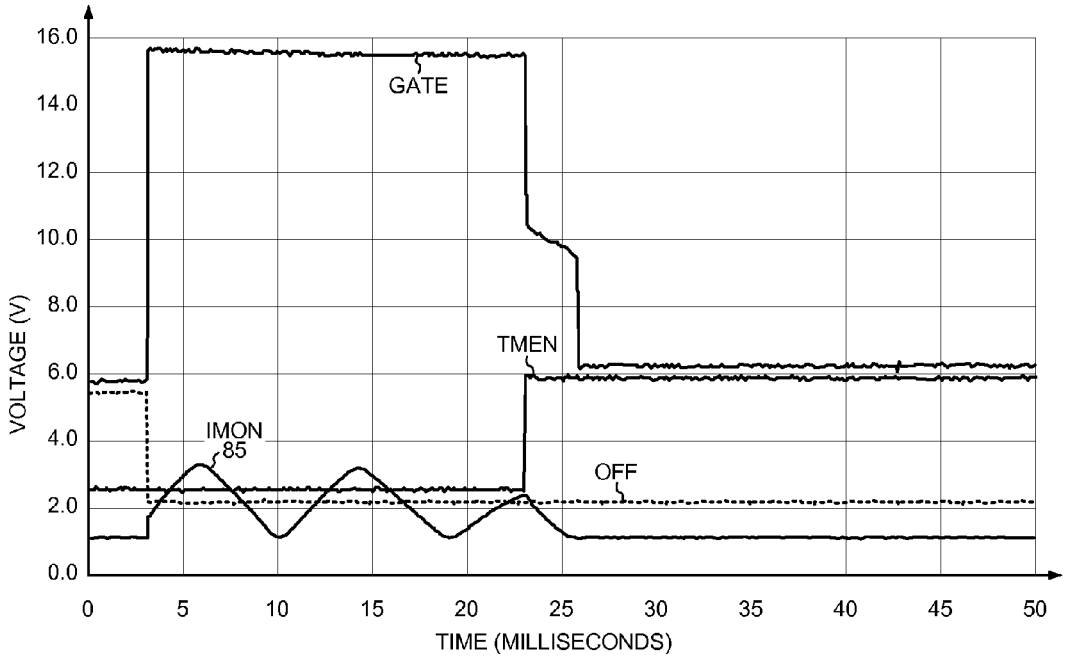
FIG. 13 is a waveform diagram of various signals on nodes of the circuitry of the starter unit shown in FIG. 5.
Figure 14:
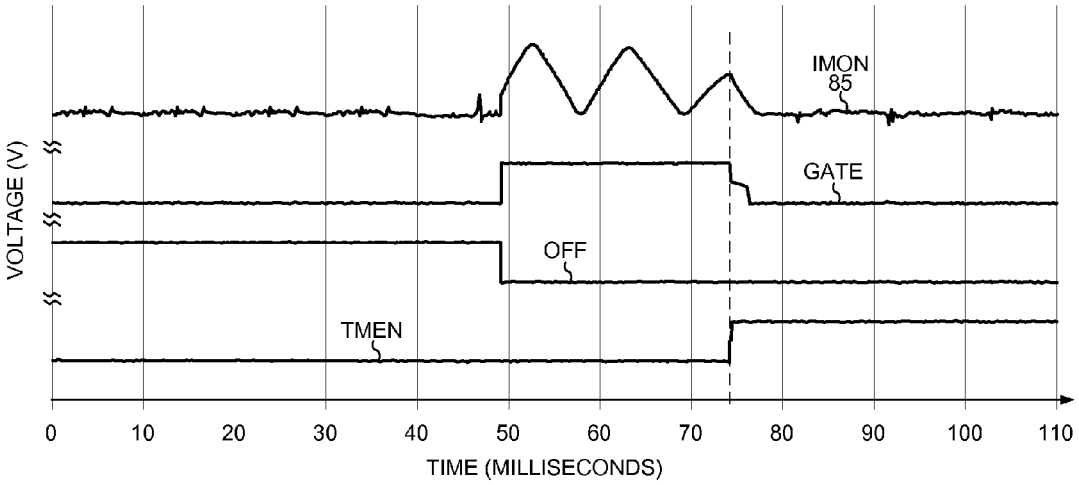
FIG. 14 shows the waveforms of FIG. 13 in which the voltage amplitudes of the various signals have been scaled for a better comparison of the waveforms.
Figure 15:
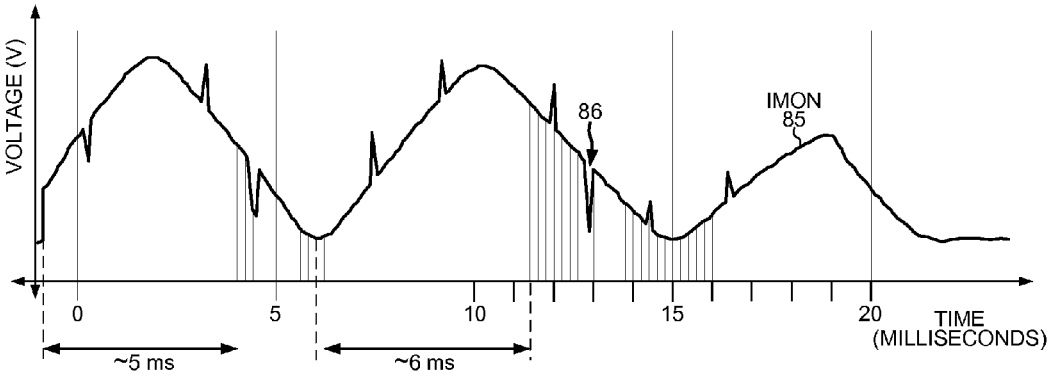
FIG. 15 is a more detailed view of a current monitoring signal of FIGS. 13-14 during the period when starter unit 15 determines that a local minimum of the signal has been reached.

FIG. 12 is a flowchart of steps 87-95 of a method for turning off a fluorescent lamp by opening main switch 38 at an appropriate time based on a local minimum of a current monitoring signal IMON 85. The method will first be described in relation to how starter unit 16 with the associated capacitive-type ballast 44 turns off lamp 14. The steps of FIG. 12 are described using the example of the waveform diagrams of FIGS. 13-14. FIG. 13 is a waveform diagram of the signals OFF, GATE, TMEN and IMON in a starter unit associated with a lamp that has a capacitive-type ballast. FIG. 13 shows voltage waveforms during the period when lamp 14 is turning off. FIG. 14 shows the waveforms of FIG. 13 in which the voltage amplitudes of the various signals have been differently scaled for a better comparison of the waveforms. FIG. 15 is a more detailed view of the IMON signal of FIGS. 13-14 during the period when starter unit 15 determines that a local minimum of the IMON signal has been reached.

In a first step 87, the illuminating current is stopped from flowing through the gas of lamp 14 by closing main switch 38. Starter unit 16 receives an RF communication 25 from master unit 11 indicating that lamp 14 should be turned off. Upon receiving the RF communication 25, microcontroller 30 identifies a spike (falling edge) in the ZXMON signal, waits about 2.5 ms, and then deasserts the OFF signal, which causes the GATE signal to be asserted, as shown in FIGS. 13-14. When the GATE signal is asserted, main switch 38 closes and current begins to flow through from node 36, through switch 38, through current sense resistor 40, and to node 37. The periodic cycles of current monitoring signal IMON 85 are present only when the voltage of the GATE signal is high. When the current from AC MAINS voltage 42 starts flowing through switch 38, the current stops flowing through the gas in lamp 14.

In a first embodiment of the sliding sample window method, a local minimum is now located, after which switch 38 is opened. In a second embodiment, a first local minimum is located, and then the starter unit searches for a second local minimum after waiting a predetermined period after the first local minimum. Then switch 38 is opened a predetermined time interval after the second local minimum. Both the first local minimum and the second local minimum are determined in the same manner. The second embodiment is described here. After the OFF signal is deasserted and switch 38 is closed, microcontroller 30 waits for about 5 ms before monitoring samples of IMON signal 85, as shown in FIG. 15. Then starter unit locates the first local minimum of IMON signal 85 using the sliding sample window method. Then starter unit waits for about 6 ms and again begins monitoring samples of IMON signal 85 in order to locate the second local minimum.

Figure 16:
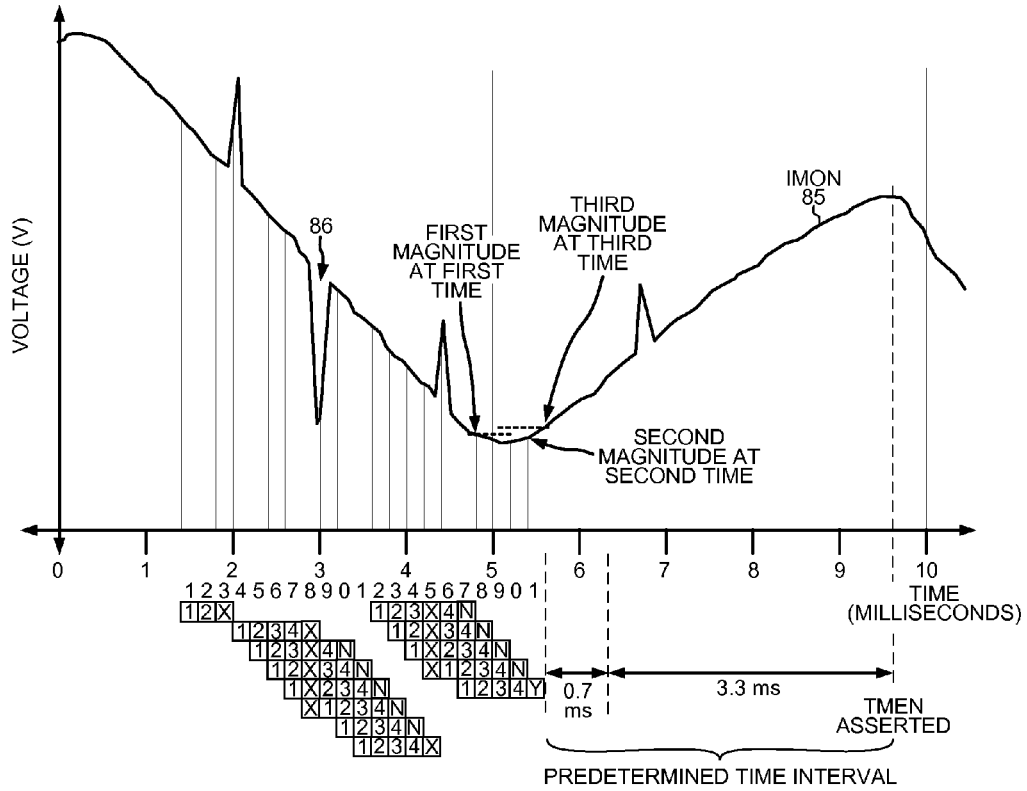
FIG. 16 illustrates an exemplary sequence of twenty-one voltage samples of the current monitoring signal used in a sliding sample window method to locate a local minimum.

FIG. 16 illustrates an exemplary sequence of twenty-one voltage samples of IMON signal 85 used in the sliding sample window method to locate the second local minimum. After waiting about 6 ms, microcontroller begins to monitor samples every two hundred microseconds. In one embodiment, a sample of the IMON signal 85 is taken every four hundred intervals of a timer having a 0.5 μs interval.

First, a window of four valid samples is acquired. In the beginning, if at least three consecutive valid samples are not found, all acquired samples are discarded, and a new attempt is made to acquire four valid samples. A sample is not valid if the difference in the magnitude of the sample and that of the closest preceding valid sample exceeds an allowable threshold difference. The threshold difference is determined based on the known typical characteristics of the ideal IMON waveform. For example, it is known that the amplitude of the ideal IMON waveform never changes by more than a certain percentage within a 200-μs period. In the example of FIG. 16, the third acquired sample has a voltage magnitude that differs from the magnitude of the second acquired sample by more than the threshold difference. In FIG. 16, "X" denotes that the sample is not valid. Because three consecutive valid samples were not found by interval three, the first three samples are discarded, and a new attempt is made to acquire four valid samples.

After a fourth valid sample is acquired at interval seven, the next sample is monitored to determine whether (i) the next sample is a valid sample, and (ii) the next sample has a magnitude that exceeds that of the first sample in the window of four valid samples. In the exemplary sample sequence, however, the sample at interval eight is not valid because of transient noise spike 86. Consequently, the window slides one increment, and the sample at interval nine is monitored to determine whether it is valid. The sample at interval nine is determined to be valid because its magnitude does not differ from the magnitude of the last valid sample at interval seven by more than the threshold difference. Here, the threshold difference is twice the threshold difference applied to the third sample because two sample intervals now separate the sample at interval nine from the last valid sample at interval seven. The threshold difference is based on the maximum possible slope (in either direction) of the IMON waveform, so the applied threshold difference is larger where the last valid sample is separated by more intervening invalid samples. Next, the sample at interval ten is monitored to determine whether it is valid and its magnitude exceeds that of the first sample in the window of four valid samples. The local minimum of IMON signal 85 is determined not yet to have occurred at interval ten because the magnitude of the sample at interval ten does not exceed the magnitude of the first sample in the window at interval five. In FIG. 16, "N" denotes that the local minimum of IMON signal 85 has not yet occurred by the interval marked "N".

The illustration of the sliding sample window method skips to interval seventeen. In the exemplary sample sequence, the local minimum has not yet been located by interval seventeen.

In step 88, a first magnitude of the IMON waveform is determined at a first time. The first time is the end of interval seventeen at which time the first valid sample of the four-sample window is identified. The samples at intervals eighteen and nineteen are also determined to be valid.

In step 89, a second magnitude of the IMON waveform is determined at a second time at interval twenty that occurs after the first time at interval seventeen. The sample at interval twenty is determined to be valid.

In step 90, a third magnitude of the IMON waveform is determined at a third time at interval twenty-one that occurs after the second time at interval twenty.

In step 91, a first difference between the third magnitude of interval twenty-one and the second magnitude of interval twenty is determined.

In step 92, a threshold difference is determined for the IMON waveform between the second time at the end of interval twenty and the third time at the end of interval twenty-one. The threshold difference represents the maximum amount that the IMON waveform without noise could possibly change from one interval to the next.

In step 93, the third magnitude at interval twenty-one is compared to the first magnitude at interval seventeen if the first difference between the third magnitude and the second magnitude is smaller than the threshold difference between the second time and the third time. In the exemplary sample sequence, the sample at interval twenty-one is valid because the first difference between the magnitudes of the samples at the twenty-first and twentieth intervals is smaller than the threshold difference. In addition, the third magnitude of the sample at interval twenty-one is determined to be larger than the first magnitude of the sample at interval seventeen.

In step 94, after the comparing in step 93, a local minimum of the IMON waveform is determined to have been reached because the third magnitude exceeded the first magnitude.

In step 95, switch 38 is opened at a predetermined time interval after the third time at the end of interval twenty-one. The waveforms of FIGS. 13-16 illustrate the operation of a starter unit associated with a capacitive-type ballast as the lamp is being turned off. The energy stored in a capacitive-type ballast was determined empirically to be at a minimum about 4.0 ms after the sliding sample window method identifies a rising sample at the third time. Consequently, the predetermined time after the third time at which switch 38 is opened is about 4.0 ms. In one embodiment in which the sliding sample window method is executed with a particular code on a Zilog Z8F2480 8-bit microcontroller, the calculations performed to determine that a local minimum has occurred, including the comparison and subtraction performed in step 93, consume about 0.7 ms. Thus, microcontroller 30 waits an additional 3.3 ms after completing the calculations before asserting the TMEN signal, which causes the GATE signal to be deasserted, as shown in FIGS. 13-14 and 16. The total time interval between when the local minimum of IMON signal 85 is reached and when switch 38 is opened is about 4.3 ms because the end of the interval at which the first increasing sample magnitude is determined typically occurs between one to two sample intervals after the local minimum occurred.

The novel sliding sample window method for determining the local minimum of IMON signal 85 is most appropriately used for turning off fluorescent lamps associated with capacitive-type ballasts because the point at which minimum energy is stored in capacitive-type ballasts occurs several milliseconds after the local minimum of IMON signal 85 is reached. The additional time required by microcontroller 30 to determine that the local minimum has been reached can simply be subtracted from the total predetermined time interval that must elapse before switch 38 is opened. The novel sliding sample window method can also, however, be used to determine the local minimum of IMON signal 85 when turning off lamps associated with inductive-type ballasts. It is not as critical to open switch 38 exactly at the point at which minimum energy is stored in an inductive-type ballast. Lamp 14 with associated inductive-type ballast 44 will typically not re-ignite even if switch 38 is opened about one millisecond after the local minimum of IMON signal 85. In addition, the 0.7 ms consumed during the calculations of the sliding sample window method can be reduced by more compact coding of the steps and by using a faster processing speed. For example, a microcontroller other than an 8-bit Z8F2480 microcontroller can be used. To avoid a lamp associated with an inductive-type ballast from re-igniting when switch 38 is opened, the predetermined time interval should be less than one quarter of a cycle of IMON signal 85.

FIG. 17 sets forth an example of compact source code for a firmware routine that implements the sliding sample window method of finding the local minimum of a current monitoring signal. The source code is compiled into a block of object code that is then executed by a Zilog Z8F2480 8-bit microcontroller on starter unit 16. The object code is stored on a computer-readable medium within microcontroller 30. For example, microcontroller 30 has an amount of FLASH memory on which the object code is stored. The object code that performs the steps of FIG. 12 is then executed by the processor of the Z8F2480 microcontroller, which is embedded in the starter unit.

Although certain specific embodiments are described above for instructional purposes, the teachings of this patent document have general applicability and are not limited to the specific embodiments described above. Although system 10 for turning off a fluorescent lamp wirelessly using a starter unit is described as being powered by a 230-volt, 60-Hz AC MAINS voltage, system 10 can also be implemented in other electrical power environments. For example, starter units 15-16 can be used to turn off fluorescent lamps that are powered by 50-Hz alternating current. And system 10 can be implemented equally well in different electrical power environments, such as those of North America and Europe. Accordingly, various modifications, adaptations, and combinations of various features of the described embodiments can be practiced without departing from the scope of the invention as set forth in the claims.

What is claimed is:

1. A method for operating a lamp, comprising:

(a) stopping an illuminating current from flowing through a gas of a lamp by closing a switch in a starter unit;

(b) taking samples of a shunt current that flows through the switch when the switch is closed, wherein the samples of the shunt current are decreasing; and (c) opening the switch at a predetermined time interval after the samples of the shunt current first begin to increase after the samples of the shunt current are decreasing in (b).

2. The method of claim 1, wherein the predetermined time interval is zero.

3. The method of claim 1, wherein the illuminating current does not begin to flow through the gas upon the opening of the switch in (c).

4. The method of claim 1, wherein samples of the shunt current are decreasing and then increasing before the taking of the samples in (b).

5. The method of claim 1, further comprising:

(d) rejecting a sample of the shunt current taken in (b) when the rejected sample is taken during a transient noise spike in the shunt current.

6. The method of claim 1, wherein the lamp remains extinguished after the switch is opened in (c).

7. The method of claim 1, wherein each of the samples is a multi-bit digital value.

8. An apparatus for operating a lamp, comprising:

a ballast adapted to receive an alternating current from an AC line voltage supply;

a fluorescent lamp coupled to the ballast, wherein the alternating current has a waveform and flows through a switch in a starter unit when the switch is closed, and wherein the alternating current flows through a gas of the fluorescent lamp when both the switch is open and the fluorescent lamp is on; and means for opening the switch when a predetermined time interval elapses following a local minimum of the waveform of the alternating current by determining when samples of the alternating current begin to increase, wherein the means is also for stopping the alternating current from flowing through the gas when the switch is open without disconnecting the AC line voltage supply from the fluorescent lamp.

9. The apparatus of claim 8, wherein the means stops the alternating current from flowing through the gas by closing the switch, and wherein the alternating current does not resume flowing through the gas upon the means opening the switch when the predetermined time interval elapses.

10. The method of claim 8, wherein the ballast is taken from the group consisting of an inductor-type ballast and a capacitor-type ballast.

11. The method of claim 8, wherein each of the samples is a multi-bit digital value.

12. A method for operating a lamp, comprising:

(a) stopping an illuminating current from flowing through a gas of a lamp by closing a switch in a starter unit;

(b) taking samples of a shunt current that flows through the switch when the switch is closed, wherein the samples of the shunt current are decreasing; and (c) opening the switch after the samples of the shunt current first begin to increase after the samples of the shunt current are decreasing in (b).

13. The method of claim 12, wherein the illuminating current does not begin to flow through the gas upon the opening of the switch in (c).

14. The method of claim 12, further comprising:

(d) using a sliding window of the samples of the shunt current to determine that the samples of the shunt current have begun to increase after the samples of the shunt current were decreasing in (b).

15. The method of claim 12, further comprising:

(d) determining that a local minimum of the shunt current has occurred when the samples of the shunt current have begun to increase after the samples of the shunt current were decreasing in (b) despite the shunt current exhibiting a transient noise spike within a quarter cycle before and after the local minimum.

16. The method of claim 12, further comprising:

(d) determining that a sample of the shunt current is invalid if a difference between a magnitude of the sample and a magnitude of a closest preceding sample exceeds a threshold difference.

17. The method of claim 12, wherein (a) through (c) are performed by a circuit that receives a turn-off command, and wherein in response to receiving the turn-off command the circuit causes the lamp to be turned off.

* * * * *